United States Patent [19]

Biricz et al.

[11] 4,121,742

[45] Oct. 24, 1978

[54] LADLE-ROTATING TURRET ARRANGEMENT

[75] Inventors: Stefan Biricz; Alois Scheinecker, both of Linz, Austria

[73] Assignee: Vereinigte Österreichische Eisen-und Stahlwerke - Alpine Montan Aktiengesellschaft, Linz, Austria

[21] Appl. No.: 777,892

[22] Filed: Mar. 16, 1977

[30] Foreign Application Priority Data

Mar. 26, 1976 [AT] Austria ..... 2217/76

[51] Int. Cl.[2] ..... B22D 41/12

[52] U.S. Cl. ..... 222/591; 52/27; 52/297; 222/168.5; 248/23; 308/237 R

[58] Field of Search ..... 248/23, 131, 289 R; 164/136, 335, 437, 438; 222/590, 591, 607, 168.5; 308/237 R, 244; 52/27, 297, 298, 704

[56] References Cited

U.S. PATENT DOCUMENTS

| | | | |
|---|---|---|---|
| 839,829 | 1/1907 | Fell | 52/297 |
| 1,735,722 | 11/1929 | Beard | 52/297 X |
| 3,552,902 | 1/1971 | Schoffmann et al. | 164/438 |
| 3,648,896 | 3/1972 | Baltz | 222/168 |
| 3,773,228 | 11/1973 | Koch et al. | 222/168 |
| 3,894,576 | 7/1975 | Schoffmann | 222/168 X |

*Primary Examiner*—Robert B. Reeves
*Assistant Examiner*—David A. Scherbel
*Attorney, Agent, or Firm*—Brumbaugh, Graves, Donohue & Raymond

[57] ABSTRACT

A ladle-rotating turret arrangement to be used in a continuous casting plant has a concrete base block with a hole through it, a central column inserted in the hole with play, carrier arms provided on the column, and two annular discs arranged at the hole at a distance from each other. At least one of the two annular discs is movable relative to the other one approximately perpendicularly to the central column and is fixable relative to the concrete base block. Annular ledges on the central column have spherical faces that rest on the two annular discs.

7 Claims, 2 Drawing Figures

LADLE-ROTATING TURRET ARRANGEMENT

BACKGROUND OF THE INVENTION

The invention relates to a ladle-rotating turret in a continuous casting plant, which turret has a central column that is provided with carrier arms and is mounted on the plant base.

It has been known to mount the central column of ladle-rotating turrets in base-supported steel substructures. In order to be able to accomodate the weight of the ladle-rotating turret as well as the weight of the ladles and to maintain a precisely vertical position of the central column without deformations, such steel constructions must be correspondingly rigid and deformation resistant. The material and production costs necessary for such steel substructures are very high because of the great precision required of the column mounting.

Concrete is a substantially cheaper construction material for the great weights of the ladle-rotating turret and it is also easier to work with. However, so far, unsolved problems have stood in the way of using concrete substructures for accommodation of a ladle-rotating turret. Thus it has not been possible to mount the central column in a concrete substructure with the precision required, since in the field of concrete construction only relatively rough measure tolerances can be observed and these rough measure tolerances can not be reconciled with the fine tolerances in the field of mechanical engineering which are necessary for achieveing a precisely vertical position for a ladle-rotating turret.

SUMMARY OF THE INVENTION

The invention aims at avoiding the above mentioned disadvantages and difficulties and has as its object to provide a ladle-rotatng turret in a continuous casting plant, which turret is absolutely vertically mountable in a concrete substructure such that the inaccuracies occuring in the concrete construction are compensated by simple means.

According to the invention, this object is achieved in that the central column is inserted with play in a hole through a concrete base block and two annular discs are arranged at the recess at a distance from each other. At least one of the discs is movable relative to the other one approximately perpendicularly to the axis of the column and is fixable relative to the concrete base block. The column is provided with annular ledges at the level of the annular discs, which annular ledges are supported by their spherical faces against the annular discs.

For accommodating the vertical forces, advantageously the central column is provided with a convex, spherical bottom face which is arranged in a bottom part closing the hole from below and forming a spherical counter-shell having a bigger sphere radius.

It is suitable if the center of the sphere of the bottom surface coincides with the center of the spherical face at the upper annular ledge.

According to a preferred embodiment, the hole in the concrete base block is lined by a pipe provided with one flange each at its ends, the annular discs being slidably guided on the flanges and fixable. Thus not only inclined positions of the axis of the central column can be compensated, but it is also possible to displace the axis parallelly.

Advantageously the upper and the lower annular discs are fixable in the radial direction on three counter-bearings evenly distributed about their periphery. These bearings are mounted on the flanges, contact the discs with interposed exchangeable spacers, and are fixable in the axial direction by screws.

Furthermore, it is advantageous if the flanges and the bottom part are braced relative to each other by screws which penetrate the concrete base block.

Suitably the column is secured against rotation by a torque support mounted on one of the flanges.

BRIEF DESCRIPTION OF THE DRAWINGS

The invention shall now be described in more detail by way of an exemplary embodiment and with reference to the accompanying drawings, wherein.

DESCRIPTION OF AN EXEMPLARY EMBODIMENT

Figure 1:
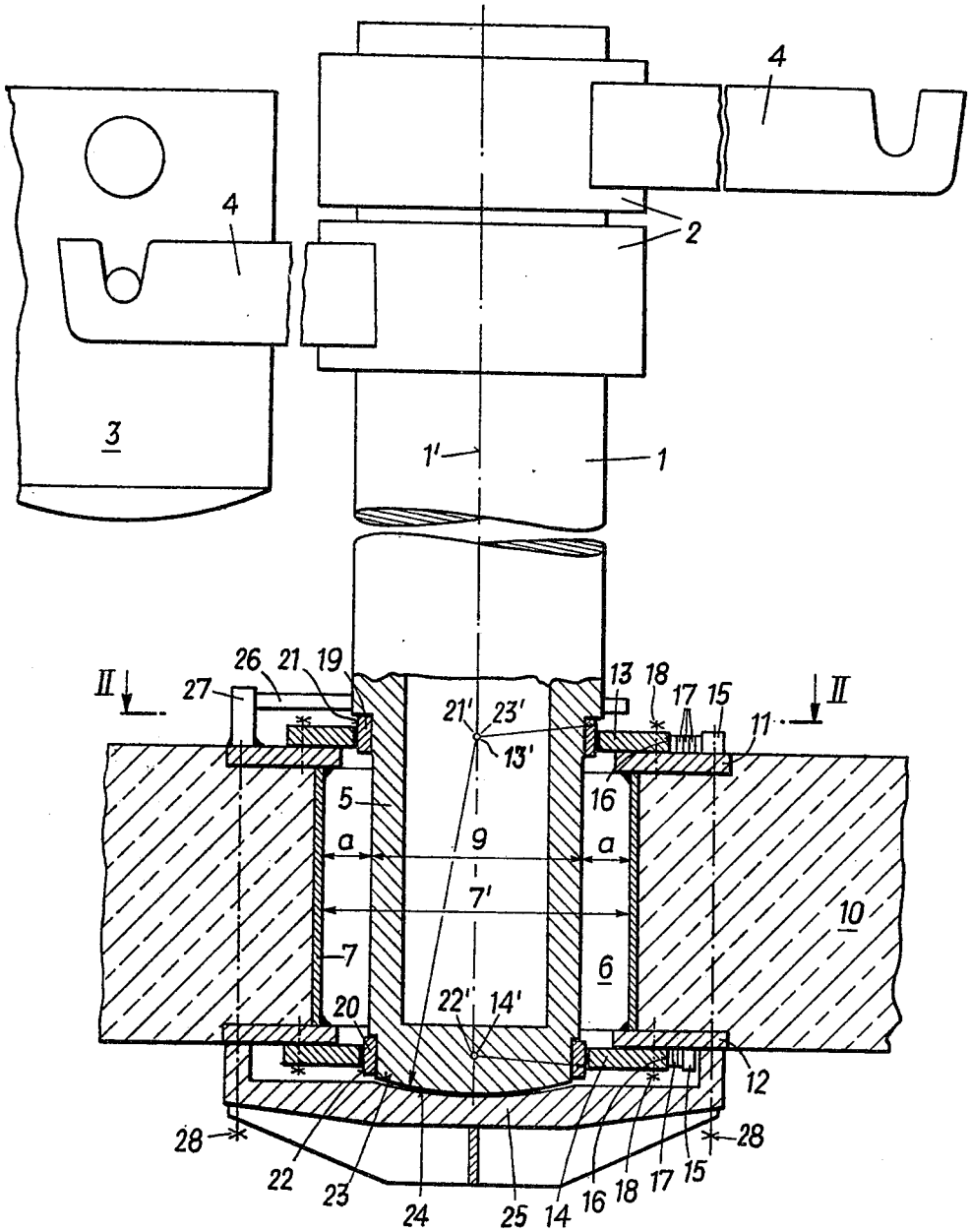
FIG. 1 is a partial vertical section, through the axis of the central column of a ladle-rotating turret.
Figure 2:
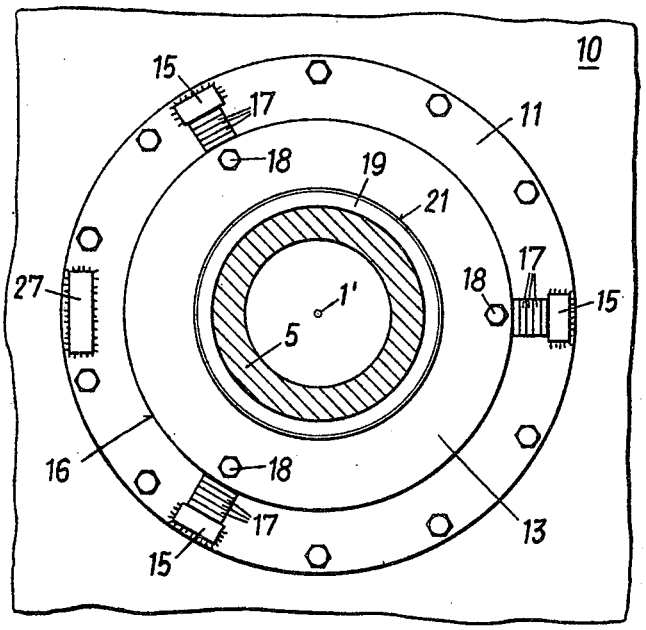
FIG. 2 is a section along line II—II of FIG. 1.

A stationary central column 1 of a ladle-rotating turret has two carrier arms 4 pivotably mounted at its upper end 2. These carrier arms have ladles 3 inserted in them. The central column is inserted with its lower end 5 into a hole 6, which hole is lined by a cylindrical pipe 7. The inner diameter 7' of the pipe 7 is wider than the outer diameter 9 of the lower end of the column by play 2a. The pipe 7 is cast in a concrete base block 10 mounted on the base, which concrete base block is designed as a concrete plate in the example illustrated. The length of the pipe 7 is so dimensioned that flanges 11 and 12 arranged at the ends of the pipe lie at the upper and lower sides of the base block 10.

Concentrical annular discs 13 and 14 lie on the flanges, the inner diameter of the annular discs being smaller than the inner diameter of the pipe. These discs are displaceable in the plane of the flanges 11 and 12.

For securing and fixing the annular discs 13 and 14 in the radial direction, three counter-bearings 15, evenly distributed over the periphery of the annular discs, are rigidly secured to each of the flanges. Between the counter-bearings and the outer edge 16 of the annular discs, exchangeable spacers 17 are inserted so that the annular discs can be fixed in each position. In the axial direction, the annular discs are secured by screws 18. At the level of the annular discs 13 and 14, annular ledges 19 and 20 are arranged at the central column, which ledges are provided with spherical outer faces 21 and 22, whose centers 21' and 22' each lie in the axis 1' of the central column. These spherical faces contact the inner face of the annular discs without play.

The weight of the ladle-rotating turret is conveyed via a convex, spherical bottom face 23 of a central column into the spherical counter-shell 24 of the bottom part 25. The sphere radius of the bottom face 23 of the central column is somewhat smaller than that of the counter-shell 24, but the center 23' of the sphere of the bottom face coincides with the center 21' of the sphere of the spherical face provided on the upper annular ledge 19. The central column is secured against rotation by a torque support 26 which rests against a counter-bearing 27 secured to the upper flange.

The flanges and the bottom part are braced relative to each other by screws 28 which penetrate the concrete base block.

When concreting the bottom plate or when concreting in the pipe, respectively, inaccuracies cannot be avoided. Thus it is possible that the pipe is concreted in a position not precisely vertical, but slightly inclined. In order to align the axis of the central column in such as case so that it is precisely vertical, the two annular discs are displaced relative to each other, until the centers 13' and 14' of the inner faces of the annular discs lie precisely above each other. Thereupon the central column can be inserted.

With this arrangement it is also possible to parallelly displace the axis of the central column, so that not only inclined positions of the pipe, but also deviations of the distance of the ladle-rotating turret to the strand guide (not illustrated), which distance has to be observed, can be compensated. The central column can also be designed as a bushing and can serve for accommodating a liftable and lowerable ladle support.

According to a modified embodiment it is possible to arrange only one adjustable annular disc 13 at the flange 11 at the upper side of the hole 6, against which the upper annular ledge 19 is supported. In such an arrangment the lower annular ledge 20 is supported by the rigid flange 12 arranged at the lower side of the hole 6. The flange 12 thus takes over the function of the lower annular disc. The bottom part 25 may be welded to the flange 12 in this embodiment.

What is claimed is:

1. A ladle-rotating turret arrangement to be used in a continuous casting plant, comprising:

a concrete base block having a hole through it;

a central column inserted in said hole with play and having an axis;

carrier arms provided on said central column;

a bottom part covering the hole in the base block from below and supporting the central column;

two annular discs arranged at said hole at a distance from each other, at least one of said two annular discs being movable relative to the other one approximately perpendicular to the axis of the central column and being fixable relative to the concrete base block; and annular ledges provided on said central column at the levels of the two annular discs, the annular ledges having spherical faces which rest against the annular discs.

2. A ladle-rotating turret arrangement as set forth in claim 1, wherein the central column has a convex spherical bottom face, the bottom part covering said hole in the concrete base block from below being in the form of a spherical counter-shell having a bigger sphere radius than the spherical bottom face of the central column.

3. A ladle-rotating turret arrangement as set forth in claim 2, wherein one of said annular ledges is an upper annular ledge and wherein the center of the spherical face of said upper annular ledge coincides with the sphere center of the spherical bottom face of said central column.

4. A ladle-rotating turret arrangement as set forth in claim 1, further comprising a pipe lining the hole in the concrete base block, said pipe being provided with one flange at each of its ends, the two annular discs being slidably guided and fixable on said flanges.

5. A ladle-rotating turret arrangement as set forth in claim 4, further comprising three counter-bearings mounted on each flange and evenly distributed about the periphery of the pertaining one of the two annular discs, exchangable spacers interposed between each annular disc and each counter-bearing to fix the two annular discs in the radial direction, and screws to fix the annular discs in the axial direction.

6. A ladle-rotating turret arrangement as set forth in claim 4, further comprising screws penetrating the concrete base block to brace the flanges and the bottom part relative to each other.

7. A ladle-rotating turret arrangement as set forth in claim 4, further comprising a torque support mounted on one of the flanges for securing the central column against a rotation around its axis.

* * * * *

UNITED STATES PATENT OFFICE

CERTIFICATE OF CORRECTION

Patent No. 4,121,742 Dated Oct. 24, 1978

Inventor(s) Biricz et al.

It is certified that error appears in the above-identified patent and that said Letters Patent are hereby corrected as shown below:

Col. 1, line 11, "accomodate" should read --accommodate--;
lines 30 & 31, "achieveing" should read --achieving---;
line 37, "ladle-rotatng" should read --ladle-rotating--;
lines 39 & 40, "occuring" should read --occurring--.

Col. 2, line 53, change "a" (both occurrences) to --the--;
line 54, change "the" (both occurrences) to --a--.

Col. 3, line 2, "such as" should read --such a--.

Col. 4, line 5, after "the" insert --two--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*